US005640872A

United States Patent [19]

Plata et al.

[11] Patent Number: 5,640,872

[45] Date of Patent: Jun. 24, 1997

[54] PROCESS AND DEVICE FOR COOLING HEATED METAL PLATES AND STRIPS

[75] Inventors: Miroslaw Plata, Vétroz; Malcolm Hill, Sierre, both of Switzerland

[73] Assignee: Alusuisse-Lonza Services Ltd., Neuhausen am Rheinfall, Switzerland

[21] Appl. No.: 495,332

[22] Filed: Jun. 27, 1995

[30] Foreign Application Priority Data

Jul. 20, 1994 [CH] Switzerland ..... 2297/94

[51] Int. Cl.[6] ..... B21B 1/00; B05B 1/26

[52] U.S. Cl. ..... 72/201; 72/365.2; 239/551

[58] Field of Search ..... 72/201, 203, 250, 72/365.2; 239/553.3, 553.5, 551

[56] References Cited

U.S. PATENT DOCUMENTS

| | | | |
|---|---|---|---|
| 4,047,985 | 9/1977 | Greenberger | 72/201 |
| 4,064,295 | 12/1977 | Singer | 427/424 |
| 4,132,393 | 1/1979 | Nakamura et al. | 72/201 |
| 4,511,089 | 4/1985 | Ebata et al. | 239/553.3 |

FOREIGN PATENT DOCUMENTS

| | | |
|---|---|---|
| 0429394 | 5/1991 | European Pat. Off. . |
| 0578607 | 1/1994 | European Pat. Off. . |
| 3316992 | 11/1984 | Germany . |
| 2139249 | 11/1984 | United Kingdom . |

OTHER PUBLICATIONS

Soviet Inventions Illustrated, Section Ch, Week 8706, 11. Feb. 1987, Derwent Publications Ltd., Soviet Unit 1,237, 285, Jun. 15, 1986.

Database WPI—Week 7709, Derwent Publication Ltd., London GB; AN 77-16169Y & Soviet Union 509,315, dated Apr. 1976.

Patent Abstracts of Japan, vol. 14, No. 397 (C-752) 28. Aug. 1990 & Japanese 2,149,357 (A), Jun. 1990.

*Primary Examiner*—Lowell A. Larson
*Assistant Examiner*—Thomas C. Schoeffler
*Attorney, Agent, or Firm*—Bachman & LaPointe, P.C.

[57] ABSTRACT

In a process for cooling hot rolled metal plates (16) and strips, especially such of aluminium or an aluminium alloy, a hot rolled strip (12) is cut to plates (16) immediately after it emerges from a rolling mill (10). Immediately after the cutting to length, the plates (16) pass through a cooling station (20) where they are jetted directly with water from flat stream nozzles (52). The water stream (W) emerging from the flat stream nozzles (52) form essentially a plane (E) which is directed at the plate surface (32). Immediately after it leaves the flat stream nozzle (52), the water stream (W) is periodically deflected by means of streams (A, B) of air or water in such a manner that the water stream (W) striking the plate surface (32) performs a wiping action.

11 Claims, 5 Drawing Sheets

PROCESS AND DEVICE FOR COOLING HEATED METAL PLATES AND STRIPS

BACKGROUND OF THE INVENTION

The invention relates to a process and a device for cooling hot rolled metal plates and strips, especially such of aluminium or an aluminium alloy in which a hot rolled strip is cut to plates or strips after it emerges from a rolling mill.

As it leaves a hot-rolling mill, a hot-rolled strip is normally at a temperature of approximately 300° to 500° C. In order to manufacture plates out of this, the hot-rolled strip is cut immediately after it leaves the hot-rolling mill. As there is no suitable seal-proof material for suction pads that can be employed at temperatures above 300° C., the hot plates have to be removed from the hot line by means of grappling tools which enable the plates to be stacked. This handling of the plates is labour intensive and undesirable marks from the grappling tools may remain on the surface of the plates. Rapid cooling of the plates could in principle be achieved by means of the rolling emulsion during a series of roll-passes without any reduction in thickness. The large differences in temperature this would produce in the hot-rolled strip would, however, lead to unacceptable deviations in flatness of the plates.

If a hot-rolled strip is to be rolled further, it is often also advantageous to cool the strip as it is introduced into the tandem mill of a finishing line or in a reversing stand. It is, however, important that no deviations in flatness are produced as a result of this form of cooling.

Known from the European patent EP-A-343 103 is a process for cooling extruded sections and rolled strip, by means of which water mist is created for cooling purposes. Because of the small amount of heat transfer, however, this process is not suitable for rapid in-line cooling of hot rolled plate thicker than about 5 mm. This previously known method of cooling with spray nozzles is described in EP-A-0 429 394 for cooling cast metal strands.

Described in EP-A-0587 607 is an in-line method for cooling sections emerging from an extrusion press, whereby the spray nozzles described in EP-A-0343 103 are employed, built in as modules.

In view of the above, the object of the present invention is to provide a process and a device of the kind described at the start, by means of which plates and strips can be cooled in a controlled manner and as fast as possible to a temperature of about 250° C. at maximum, without deviations in flatness occurring in the plates.

SUMMARY OF THE INVENTION

That objective is achieved by way of the invention in that the plates or strips, immediately after cutting, continuously pass through a cooling station in which they are jetted directly with water from flat stream nozzles, the water jet from the flat stream nozzles forming an essentially plane directed at the surface of the plates or strips and, immediately after leaving the flat stream nozzle, the water jet is periodically diverted by means of air or water jets in such a manner that the stream of water striking the surface of the plates or strips makes a wiping movement.

The use flat stream nozzles according to the invention results in a narrow impingement area with high heat transfer where the water jet strikes the surface of the plate or strip. This local, high heat transfer along with the wiping action leads to uniform removal of heat. The in-line cooling of the plates or strips to a temperature less than 300° C. leads to a considerable increase in production. Furthermore, after they have passed through the cooling station, the plates can be removed from the rolling line and stacked using conventional vacuum systems.

To achieve the said wiping action, the water jet emerging from the flat stream nozzle is tilted preferably over an angle in a range of 30° to 120°.

The distance between the outlet in the flat stream nozzle and the surface of the plate or strip is preferably set at approximately 100 to 200 mm.

The area of impingement of the water jet on the surface of the plates or strips is preferably 5 to 10 mm in width, the length to breadth ratio lying between 5:1 and 100:1.

A suitable frequency for the wiping action according to the invention lies between about 0.1 and 20 Hz. Preferred is a wiping action at a frequency of about 0.5 to 2 Hz.

In a preferred device for carrying out the process according to the invention employing flat stream nozzles, the said nozzles are arranged on nozzle beams running in the direction of movement of the plates or strips. The nozzle beams preferably comprise a longitudinal water channel and two longitudinal air channels; the water channel feature short channels branching off to the nozzles and the air channels terminate in air gaps directed at the nozzle outlets.

The nozzle beams may be divided into modules that can be supplied separately with water, or be made up of such modules. A preferred design of the device according to the invention is such that the nozzle beams or modules exhibit a—preferably extruded—main body into which the flat stream nozzles are mounted in such a manner that they can be exchanged. Mounted on the main body are covers that together with the main body preferably form air chambers and feature an air gap directed at the nozzle outlets and the air chambers are connected to the air channels via connecting channels.

Further advantages, features and details of the invention are revealed in the following description of preferred exemplified embodiments and with the aid of the drawing; this shows schematically in:

DETAILED DESCRIPTION OF PREFERRED EMBODIMENTS

Figure 1A:
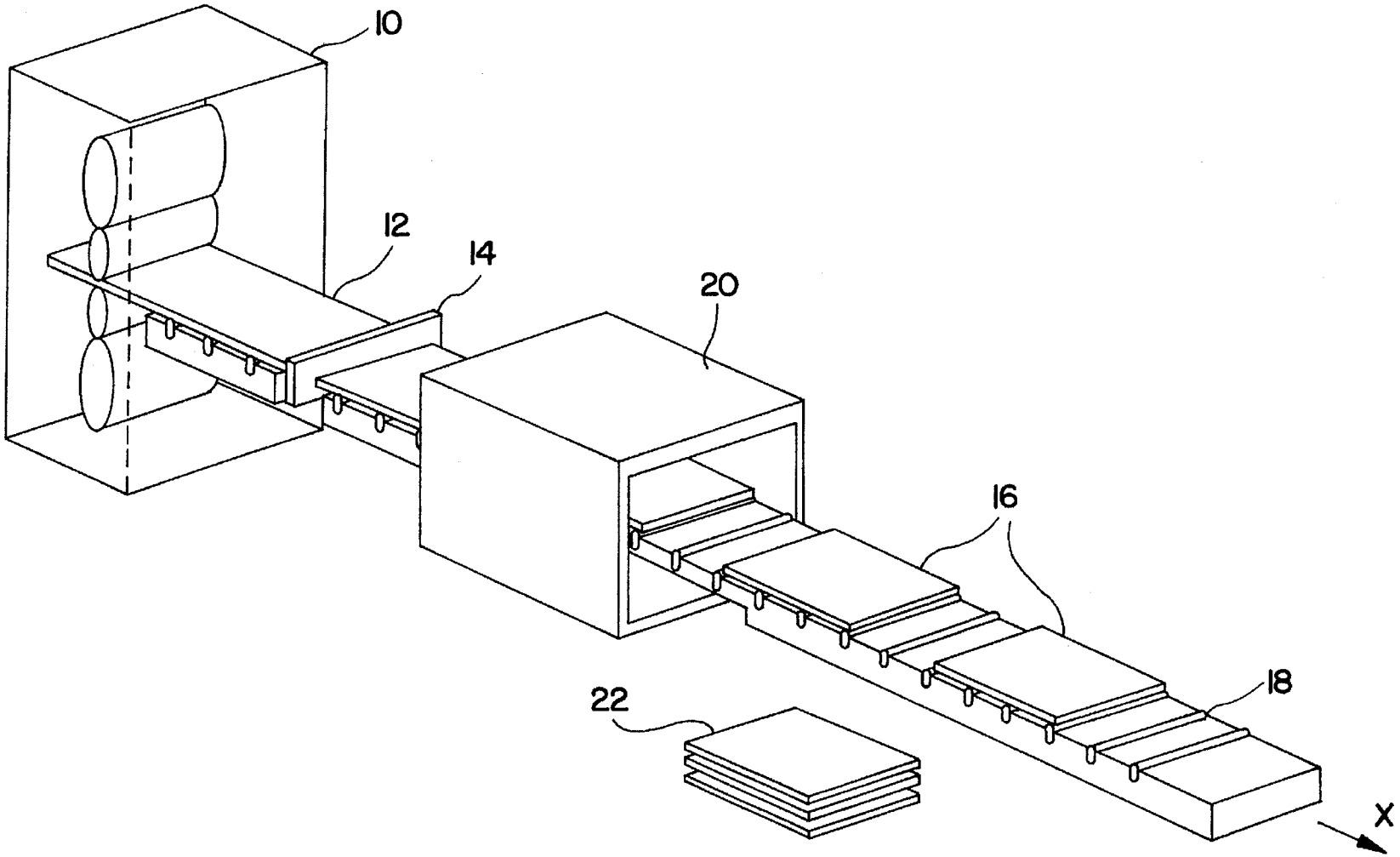
FIG. 1*a* an overview of a hot rolling mill with cooling station downstream of the roll stand.

As shown in FIG. 1*a,* a hot rolled strip 12 emerges from a hot rolling mill 10, is cut to length by means of shears or a saw 14 to plates 16 and transported in direction x along a track 18 through a cooling station 20. The plates 16 cooled in the cooling station 20 are stored in stacks 22 until further processing.

Figure 1B:
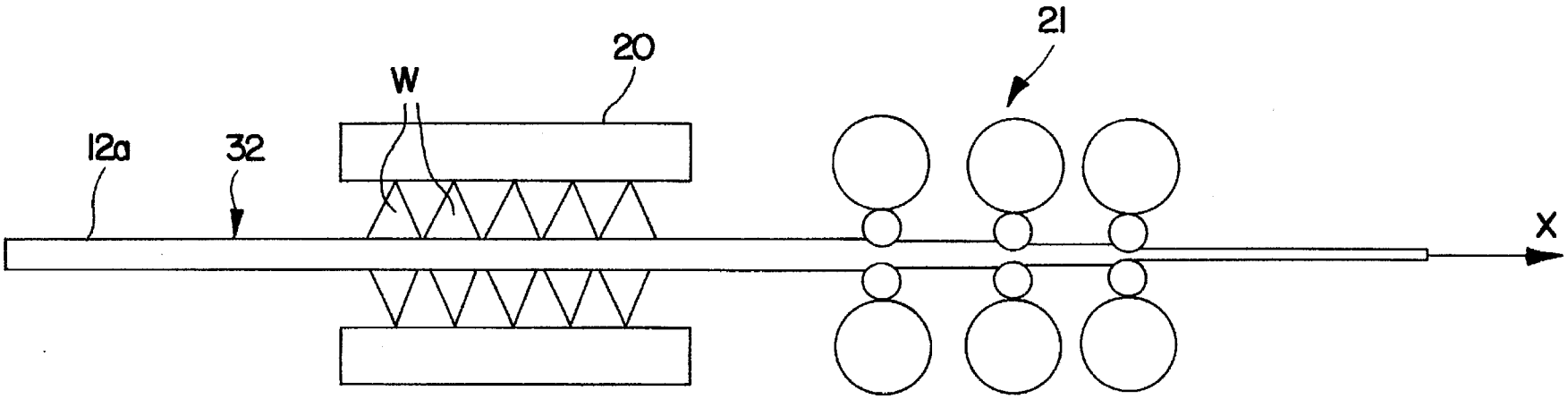
FIG. 1*b* a part of a finishing line with a cooling station.

In FIG. 1*b* a length 12*a* of hot rolled strip material is passing through a cooling station 20 which in this case is situated ahead of a tandem mill 21 in a finishing line. Instead of a tandem mill 21 this could be a reversing mill.

Figure 3:
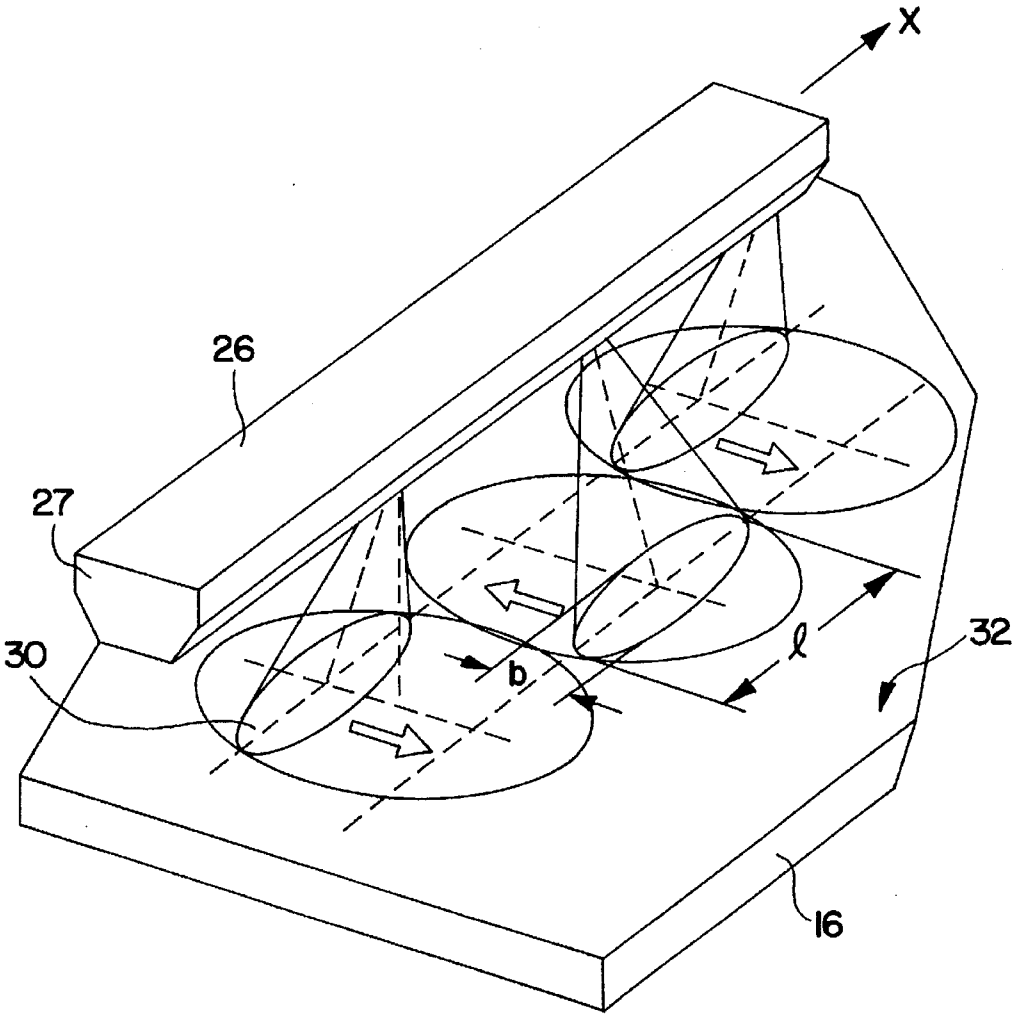
FIG. 3 an inclined view off a module of a nozzle beam.
Figure 2:
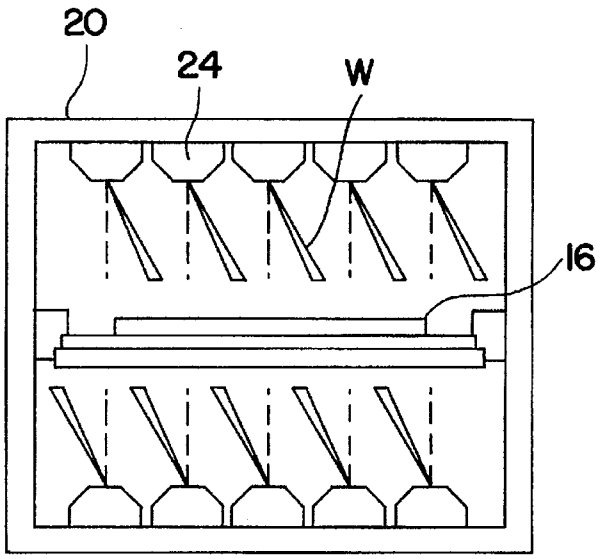
FIG. 2 a cross-section through the cooling station shown in FIG. 1*a;*
Figure 4:
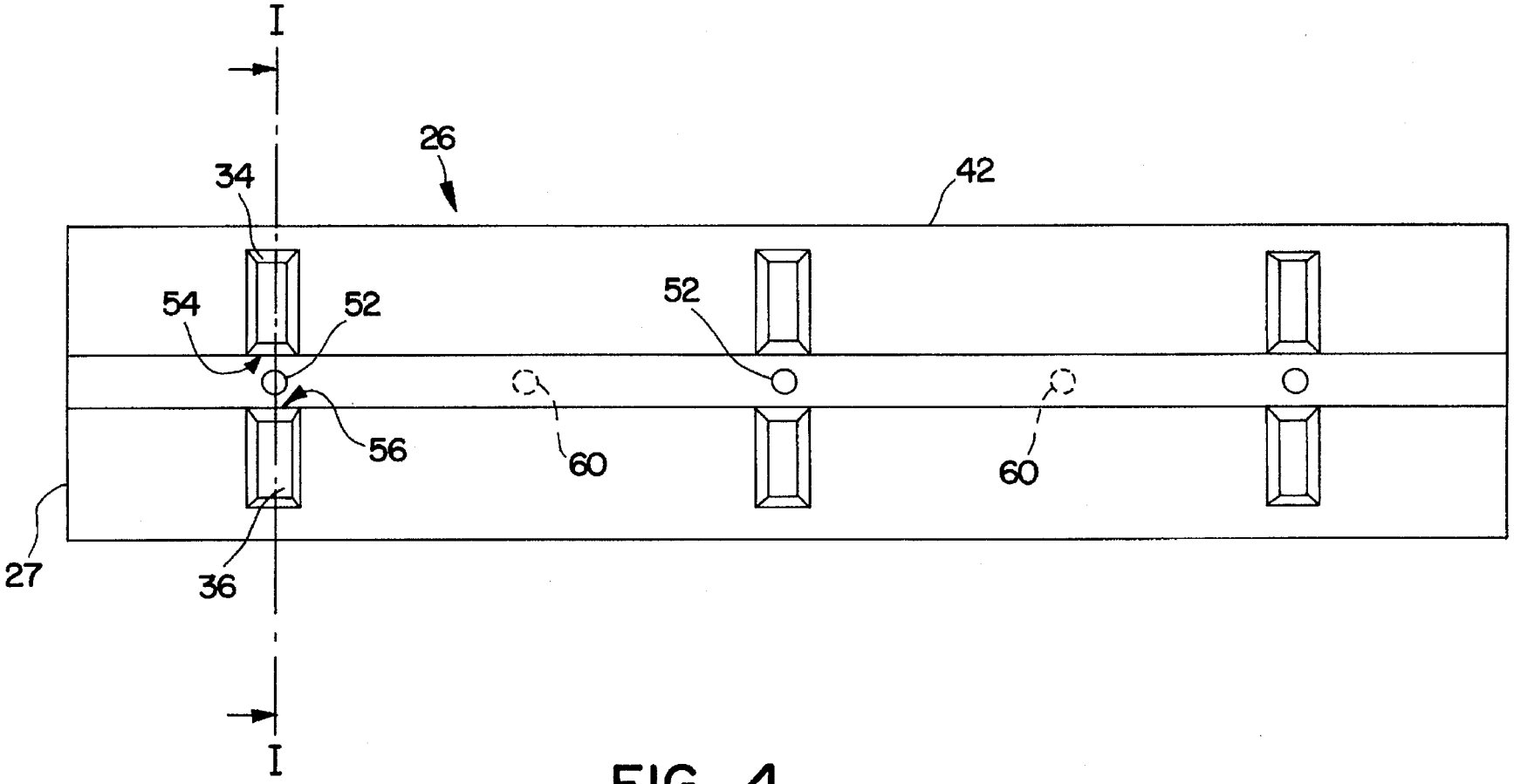
FIG. 4 a view of a module counter to the direction of the stream.

Arranged within the cooling station are, as shown in FIG. 2, lower and upper nozzle beams 24 running in the direction x in which the plates or strips are transported. FIGS. 3 and 4 show modules 26 with three flat stream nozzles. 52. The outlets 53 of the flat stream nozzles 52 which are a distance of e.g. 150 mm from the surface 32 of the plate 32 or strip 12*a*, are arranged at a regular spacing of e.g. 100 to 200 mm apart. Shown there are also covers 34, 36 for the air chambers 38, 40. If required there are also additional water jet nozzles 60, which may be switched on if the cooling action of the flat stream nozzles is insufficient for cooling thick plates 16 or strips 12*a* at the given rate of transport.

The modules 26, arranged end 27 on end 27 or spaced slightly apart, form the upper and lower nozzle beams 24. Each module 26 may be supplied separately with air and water. As can be seen in particular in FIG. 5, the module features a—usefully extruded—main body 42 with a longitudinal central water channel 46 and on both sides which are longitudinal air channels 48, 50.

The air channels 48, 50 are connected to the air chambers 38, 40 via connecting channels 62, 64. These air chambers 38, 40 are formed by covers 34, 36 which are bolted to the main body 42. Between the cover 34, 36 and the surface of the main body 42 inclined at an angle of approximately 45° is an air gap 54, 56 directed at the nozzle outlet 53.

The water channel 46 is connected to the flat stream nozzle via short channels 58. The additional water jet nozzles 60 are when required supplied with water via a separate channel not shown in the drawing.

Figure 5:
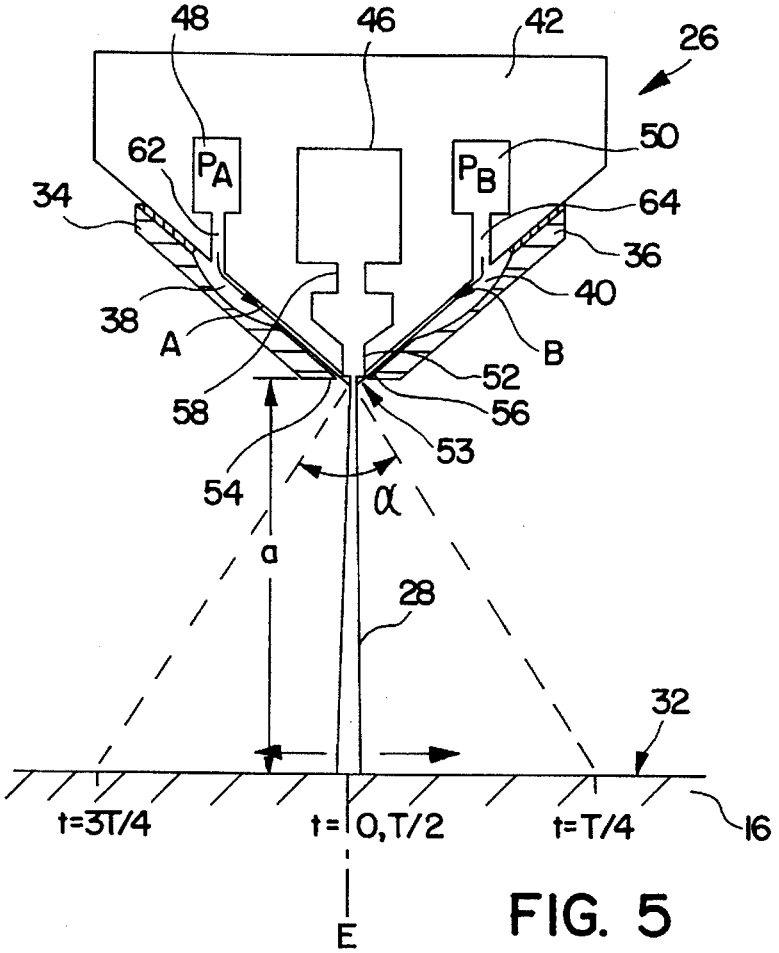
FIG. 5 a section through FIG. 4 along line I—I.

The manner in which a module 26 operates is explained in the following with the aid of FIGS. 5 to 7.

An essentially flat stream W of water emerges from the flat stream nozzle 52. The direction of this water stream W is then alternately deflected by the air streams A and B which emerge from the air gaps 54 and '56' respectively, such that in all an angle of deflection α is produced.

Figure 6:
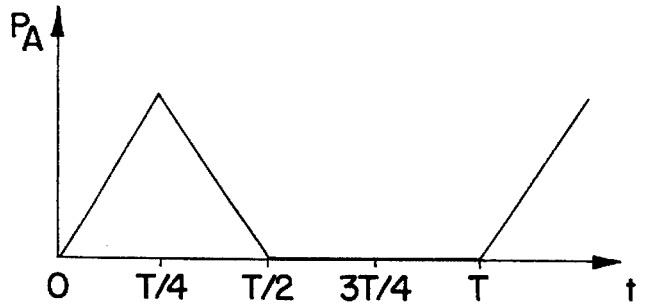
FIG. 6 the air pressure in a first air channel as a function of time.
Figure 7:
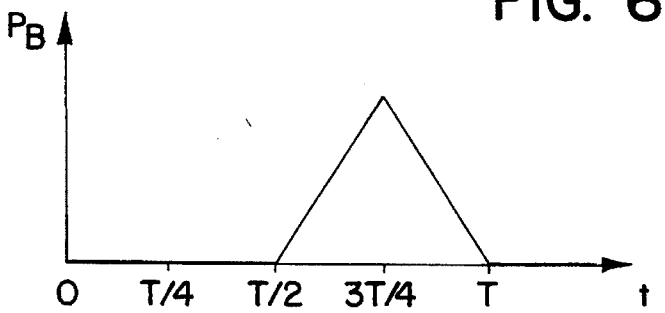
FIG. 7 the air pressure in a second channel as a function of time.

The air prevailing pressure in both air streams A,B at any particular point in time t is shown in FIGS. 6 and 7. The setting of the air pressure p takes place in the related air channel 48 and 50. The water stream W is first deflected to the maximum extent out of its normal path first by air stream A and then brought back to its normal path. This is followed by the second air stream B deflecting the water stream W to the full extent in the other direction and again back to the normal path. This alternating, periodic deflection with a length of period T takes place e.g. at a frequency of about 1 Hz.

The air streams A and B for deflecting the water stream W may in principle be replaced by water streams, whereby in such a case the amount of water comprising the water stream W and the deflecting water streams is preferably kept constant.

As can be seen especially in FIG. 3, the wiping action of the water jet W coming from the flat stream nozzles 52 is a movement which is transverse to the direction x in which the plate 16 or strip 12*a* is transported, each successive nozzle performing the wiping movement in the direction opposite to that of the nozzle preceding it.

The length l of the area of impingement 30 where the water stream W strikes the surface 32 of the plate 16 or strip 12*a* is e.g. 200 mm, the breadth b e.g. 5 mm. The flat stream nozzles 52 are arranged in the nozzle beam 24 or modules 26 in such a manner that during wiping the impingement areas 30 of neighbouring water streams W touch each other slightly.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

We claim:

1. A process for cooling hot rolled and cut metal plates transported in a direction X from a hot rolling mill to a cutting station and thereafter through a cooling station, the improvement comprising: providing the cooling station with a plurality of flat stream nozzle means arranged along direction X for directing a water jet (W) along a plane (E) substantially parallel to direction X and perpendicular to a top surface of the hot rolled and cut metal plates; transporting a hot rolled and cut metal plate through the cooling zone in direction X; initially directing the water jet (W) from the flat stream nozzle means onto the surface of the hot rolled and cut plate substantially perpendicular thereto; and thereafter periodically deflecting the water jet (W) to either side of plane (E) such that the water jet (W) strikes the surface of the plate at an acute angle so as to make a wiping action.

2. A process according to claim 1, wherein the water stream (W) emerging from the flat stream nozzle means is deflected over an angle (α) of between about 30° to 120°.

3. A process according to claim 1, wherein the flat stream nozzle means is spaced from the surface of the plate by a distance (a) of between about 100 to 200 mm.

4. A process according to claim 1, wherein the water stream (W) initially impinges on the plate having an area defined as follows: a breadth (b) of about 5 to 10 mm and a ratio of length (l) to breadth (b) of 5:1 to 100:1.

5. A process according to claim 1, wherein the frequency of the wiping action is between about 0.1 to 20 Hz, preferably 0.5 to 2 Hz.

6. A process according to claim 1, wherein the frequency of the wiping action is between about 0.1 to 20 Hz, preferably 0.1 to 2 Hz.

7. A device for cooling hot rolled and cut metal plates transported in a direction X from a hot rolling mill to a cutting station and thereafter through a cooling station, the improvement comprising: the cutting station having at least one nozzle beam means extending along direction X, said nozzle beam means comprising a flat stream nozzle means arranged along direction X for directing a water jet (W) along a plane (E) substantially parallel to direction X and perpendicular to a top surface of the hot rolled and cut metal plates and a water jet deflecting means for deflecting the water jet (W) to either side of the plane (E) such that the water jet (W) strikes the surface of the plate at an acute angle so as to make a wiping action; and control means for activating the water jet deflecting means periodically after initial direction of the water jet (W) from the flat stream nozzle onto the surface of the hot rolled and cut plate.

8. A device according to claim 7, wherein said flat stream nozzle means comprises a longitudinal water channel and said water jet deflecting means comprises at least two longitudinal air channels, said water channel featuring short channels branching off into nozzle outlets and the air channels terminate in air gaps directed at the nozzle outlet.

9. A device according to claim 7, wherein the nozzle beam means are subdivided into modules that can be supplied separately with water.

10. A device according to claim 9, wherein the flat stream nozzle means are removably mounted in the modules.

11. A nozzle for use in cooling hot rolled and cut metal plates comprising a flat stream nozzle means for producing a water jet and a plurality of water jet deflecting means mounted on either side of the flat stream nozzle means for deflecting the water jet issuing from the flat stream nozzle means.

* * * * *